US010278555B2

(12) United States Patent
Rupp et al.

(10) Patent No.: US 10,278,555 B2
(45) Date of Patent: May 7, 2019

(54) VACUUM CONDUIT ATTACHMENT TOOL FOR CONNECTION TO DIFFERENT SIZED VACUUM CONDUITS

(71) Applicant: Emerson Electric Co., St. Louis, MO (US)

(72) Inventors: Megan Rupp, Kansas City, MO (US); Alex J. Wall, St. Louis, MO (US); Daniel M. Henke, Edwardsville, IL (US)

(73) Assignee: Emerson Electric Co., St. Louis, MO (US)

( * ) Notice: Subject to any disclaimer, the term of this patent is extended or adjusted under 35 U.S.C. 154(b) by 148 days.

(21) Appl. No.: 15/250,129

(22) Filed: Aug. 29, 2016

(65) Prior Publication Data

US 2018/0055314 A1 Mar. 1, 2018

(51) Int. Cl.

| | |
|---|---|
| ***A47L 9/06*** | (2006.01) |
| ***A47L 7/00*** | (2006.01) |
| ***A47L 9/14*** | (2006.01) |
| ***A47L 9/24*** | (2006.01) |
| ***A47L 5/36*** | (2006.01) |
| ***A47L 9/02*** | (2006.01) |

(52) U.S. Cl.
CPC ..... *A47L 5/365* (2013.01); *A47L 9/02* (2013.01); *A47L 9/242* (2013.01)

(58) Field of Classification Search
CPC .... A47L 9/0673; A47L 7/0009; A47L 9/1409; A47L 9/24; A47L 5/365; A47L 9/02; A47L 9/242
See application file for complete search history.

(56) References Cited

U.S. PATENT DOCUMENTS

| | | | | |
|---|---|---|---|---|
| 3,602,531 A * | 8/1971 | Patry | F16L 21/002 285/148.23 |
| 5,042,844 A * | 8/1991 | Iida | A47L 9/242 285/251 |
| 5,452,493 A | 9/1995 | Galindo | |
| 5,921,586 A * | 7/1999 | Prassas | F16L 47/00 285/12 |

(Continued)

OTHER PUBLICATIONS

"Inflator Nozzle for 1-1/4" or 2-1/2" Hoses—Shop-Vac Accessories"; <https://www.shopvac.com/shopvac-accessories/Products/Inflator-Nozzle-for-1-14-or-2-12->; retrieved Jan. 11, 2016.

(Continued)

*Primary Examiner* — Marc Carlson
(74) *Attorney, Agent, or Firm* — Armstrong Teasdale LLP

(57) ABSTRACT

An attachment tool for a vacuum cleaning system includes a hollow body that extends from a first end to a second end and defines a flow path, and a conduit connector disposed at the second end of the body. The first end of the hollow body defines an inlet for receiving debris therethrough. The conduit connector includes an outer collar that defines a first inner engagement surface for connection to an outer diameter of a first vacuum conduit, and an inner collar that is concentric with the outer collar and defines a second inner engagement surface for connection to an outer diameter of a second vacuum conduit smaller than the outer diameter of the first vacuum conduit. The inner collar is axially offset from the outer collar towards the first end of the body.

20 Claims, 10 Drawing Sheets

(56) References Cited

U.S. PATENT DOCUMENTS

| | | | | |
|---|---|---|---|---|
| 6,785,934 | B2 | 9/2004 | Bruno et al. | |
| 7,350,824 | B2 * | 4/2008 | Petner | E03C 1/304 15/353 |
| 7,617,566 | B2 * | 11/2009 | Chapman | A47L 9/02 15/344 |
| 8,113,543 | B1 * | 2/2012 | Romani | A01K 13/001 15/419 |
| 8,985,635 | B2 * | 3/2015 | Hurley | F24F 13/222 285/179 |
| 9,752,712 | B2 * | 9/2017 | Farland | F16L 25/14 |
| 2015/0198274 | A1 * | 7/2015 | Farland | F16L 25/14 285/7 |

OTHER PUBLICATIONS

"Shop-Vac Drain Hero (9193400)—Wet / Dry Vacuum Accessories—Ace Hardware"; <http://www.acehardware.com/product/index.jsp?productId=11967743&KPID=11021708&,>; retrieved Aug. 10, 2015.

* cited by examiner

VACUUM CONDUIT ATTACHMENT TOOL FOR CONNECTION TO DIFFERENT SIZED VACUUM CONDUITS

FIELD

The field of the disclosure relates generally to vacuum cleaning systems, and more particularly, to vacuum conduit attachment tools for connection to vacuum conduits of different sizes.

BACKGROUND

Vacuum cleaners typically include a suction unit, a conduit (e.g., a flexible hose or tube) connected to the suction unit, and an attachment tool connected to the tube for engaging a surface to be cleaned. Many prior vacuum cleaner attachment tools are generally designed for use with only one size of vacuum tubes or hoses. Thus, prior attachment tools are not readily adaptable for use with vacuum tubes or hoses of varying sizes. Consequently, use of such prior attachment tools with vacuum tubes or hoses of different sizes requires a separate adapter or a separate attachment tool altogether. This, in turn, requires that numerous different vacuum accessories (e.g., attachment tools and adapters) be kept on hand to ensure compatibility across different sizes of vacuum tubes and hoses.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a vacuum cleaning system includes a suction unit, a vacuum conduit connected to the suction unit, and an attachment tool connected to an end of the vacuum conduit. The attachment tool includes a hollow body that extends from a first end to a second end and defines a flow path, and a conduit connector disposed at the second end of the body. The first end of the hollow body defines an inlet for receiving debris therethrough. The conduit connector includes an outer collar that defines a first inner engagement surface, and an inner collar that is concentric with the outer collar and defines a second inner engagement surface. The inner collar is axially offset from the outer collar towards the first end. The attachment tool is connected to the vacuum conduit along one of the first inner engagement surface and the second inner engagement surface, and is selectively attachable to vacuum conduits of different diameters along the first and second inner engagement surfaces.

In another aspect, an attachment tool for a vacuum cleaning system includes a hollow body that extends from a first end to a second end and defines a flow path, and a conduit connector disposed at the second end of the body. The first end of the hollow body defines an inlet for receiving debris therethrough. The conduit connector includes an outer collar that defines a first inner engagement surface for connection to an outer diameter of a first vacuum conduit, and an inner collar that is concentric with the outer collar and defines a second inner engagement surface for connection to an outer diameter of a second vacuum conduit smaller than the outer diameter of the first vacuum conduit. The inner collar is axially offset from the outer collar towards the first end of the body.

In yet another aspect, a method of assembling a vacuum cleaning system is described. The vacuum cleaning system includes a suction unit, a vacuum conduit, and an attachment tool. The attachment tool includes a hollow body that extends from a first end to a second end and defines a flow path, and a conduit connector disposed at the second end of the body. The conduit connector includes an outer collar defining a first inner engagement surface, and an inner collar concentric with the outer collar and defining a second inner engagement surface. The inner collar is axially offset from the outer collar towards the first end. The method includes connecting a first end of the vacuum conduit to the suction unit, determining a diameter of a second end of the vacuum conduit, selecting, based on the diameter of the second end of the vacuum conduit, one of the engagement surfaces of the attachment tool for connection to the vacuum conduit, and connecting the vacuum conduit to the selected engagement surface.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the several views of the drawings.

DETAILED DESCRIPTION

Figure 1:
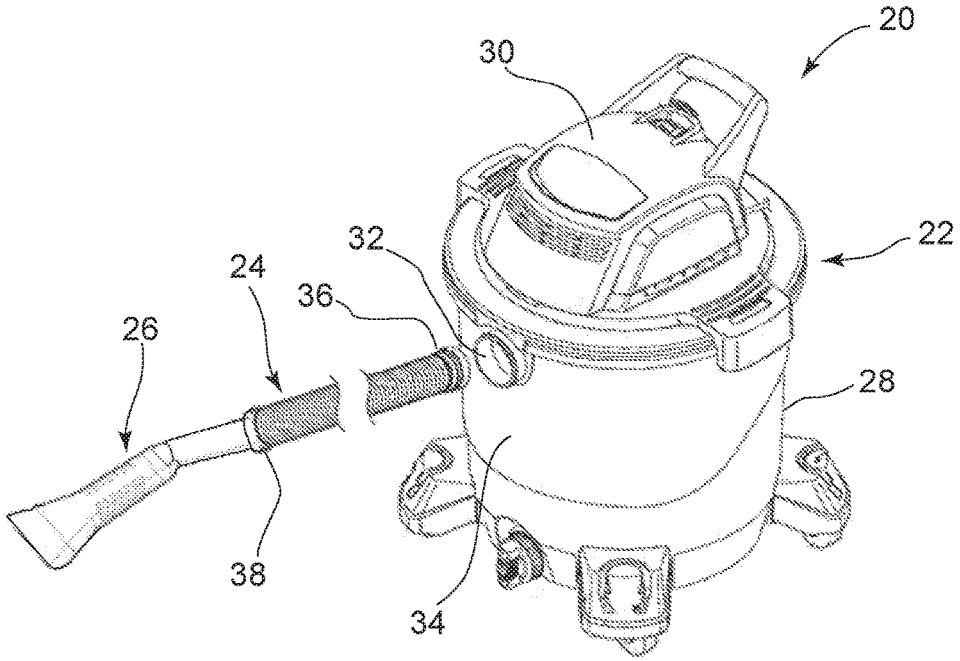
FIG. 1 is a perspective view of an example vacuum cleaning system as embodied in a wet/dry vacuum cleaner.

FIG. 1 is a perspective view of an example vacuum cleaning system 20, as embodied in a wet/dry vacuum cleaner. Although the vacuum cleaning system 20 is shown and described with reference to a wet/dry vacuum cleaner, the vacuum cleaning system 20 and features thereof may be embodied in vacuum cleaners other than wet/dry vacuum cleaners including, for example and without limitation, canister vacuum cleaners, upright vacuum cleaners, and backpack vacuum cleaners. In the example embodiment, the vacuum cleaning system 20 generally includes a suction unit 22, a vacuum conduit 24 connected in fluid communication with the suction unit 22, and a vacuum conduit attachment tool 26 connected to an end of the vacuum conduit 24.

The suction unit 22 generally includes a motor and a fan or impeller assembly (not shown) operatively connected to the motor to drive the fan and generate suction or negative pressure to permit debris and other material to be collected via the vacuum conduit 24 and the vacuum conduit attachment tool 26. In the illustrated embodiment, the suction unit includes a collection drum or canister 28 and a powerhead 30 secured to, and over an open top of, the collection canister 28. The motor and impeller assembly of the vacuum cleaning system 20 are housed within the powerhead 30, and establish a negative pressure or vacuum within the collection canister 28 when activated.

The suction unit 22 also includes a vacuum inlet port 32 for connection to one end of the vacuum conduit 24. When the vacuum conduit 24 is connected to the vacuum inlet port 32, the negative pressure or vacuum established by the motor and impeller assembly is transferred to the vacuum conduit 24 and creates suction along the vacuum conduit 24. In the illustrated embodiment, the vacuum inlet port 32 is defined along an outer cylindrical wall 34 of the collection canister 28. In other embodiments, the vacuum inlet port 32 may be located at any suitable location on the suction unit 22 that enables the vacuum cleaning system 20 to function as described herein. In some embodiments, the suction unit 22 may also include one or more filter or media assemblies interfaced between the vacuum inlet port 32 and the impeller assembly to collect finer particles or media entrained within the suction flow generated by the vacuum cleaning system 20.

The suction unit 22 also includes an exhaust port (not shown) for exhausting or expelling air flow generated by the motor and impeller assembly. The exhaust port may be located at any suitable location on the suction unit 22 that allows air flow generated by the suction unit 22 to be expelled therefrom (e.g., out of the collection canister 28). For example, the exhaust port may be defined on the powerhead 30. Moreover, in some embodiments, the exhaust port may be configured for connection to the vacuum conduit 24 such that the vacuum cleaning system 20 may be used as a blower. In some embodiments, for example, the exhaust port has a configuration similar to the vacuum inlet port 32 for connection to the first end 36 of the vacuum conduit 24.

The vacuum conduit 24 includes a first end 36 that connects to the vacuum inlet port 32 of the suction unit 22, and a second end 38 distal from the first end 36 for connection to a vacuum cleaning accessory, such as the vacuum conduit attachment tool 26. Connection of the first end 36 of the vacuum conduit 24 to the vacuum inlet port 32 permits fluid communication between the suction unit 22 and the vacuum conduit 24 such that the negative pressure or vacuum established by the suction unit 22 creates suction along the vacuum conduit 24. In the illustrated embodiment, the first and second ends 36 and 38 of the vacuum conduit 24 are circular in cross-section and define circular openings for connection to the vacuum inlet port 32 and the attachment tool 26, respectively.

In the illustrated embodiment, the first end 36 of the vacuum conduit 24 is releasably connectable to the vacuum inlet port 32 (e.g., by a friction fit) such that the vacuum conduit 24 may be disconnected from the suction unit 22 and stored when not in use. In other embodiments, the first end 36 of the vacuum conduit 24 may be fixed to the vacuum inlet port 32 such that the vacuum conduit 24 is not detachable from the suction unit 22. In the illustrated embodiment, the vacuum conduit 24 includes a flexible, extendable hose. The hose may be made of a flexible material such as plastic, polypropylene (PP), polyethylene (PE), ethylene vinyl acetate (EVA), rubber, and other flexible materials. Further, in the illustrated embodiment, the first and second ends 36 and 38 of the vacuum conduit 24 include annular rings having a relatively rigid construction as compared to the flexible hose to facilitate connection to the vacuum inlet port 32 and the attachment tool 26, respectively. In some embodiments, for example, the first end 36 and the second end 38 are constructed of the same materials as the vacuum conduit 24, and have a more rigid construction (e.g., thicker sidewalls). In other embodiments, the ends of the vacuum conduit 24 may be constructed of any suitable semi-rigid or flexible materials that enable the vacuum cleaning system 20 to function as described herein.

In other embodiments, the vacuum conduit 24 may include a rigid tube in addition to or as an alternative to the flexible hose. In such embodiments, the tube may be constructed from suitably rigid materials including, for example and without limitation, rigid and/or pliable plastics, nylons, rubbers, and metals. In other embodiments, the vacuum conduit 24 may be constructed of any suitable material that enables the vacuum cleaning system 20 to function as described herein.

The vacuum conduit attachment tool 26 is connected to the second end 38 of the vacuum conduit 24 such that the attachment tool 26 can be manipulated to engage surfaces for cleaning (e.g., floors or other surfaces). The attachment tool 26 is releasably connected to the second end 38 of the vacuum conduit 24 such that the attachment tool 26 can be interchanged with other vacuum conduit attachment tools (for example, the vacuum conduit attachment tools shown in FIGS. 9 and 10) designed for different vacuum cleaning operations. As described in more detail herein, the attachment tool 26 includes an integrated conduit connector to facilitate connecting different sized (e.g., diameter) vacuum conduits to the vacuum conduit attachment tool 26.

Figure 2:
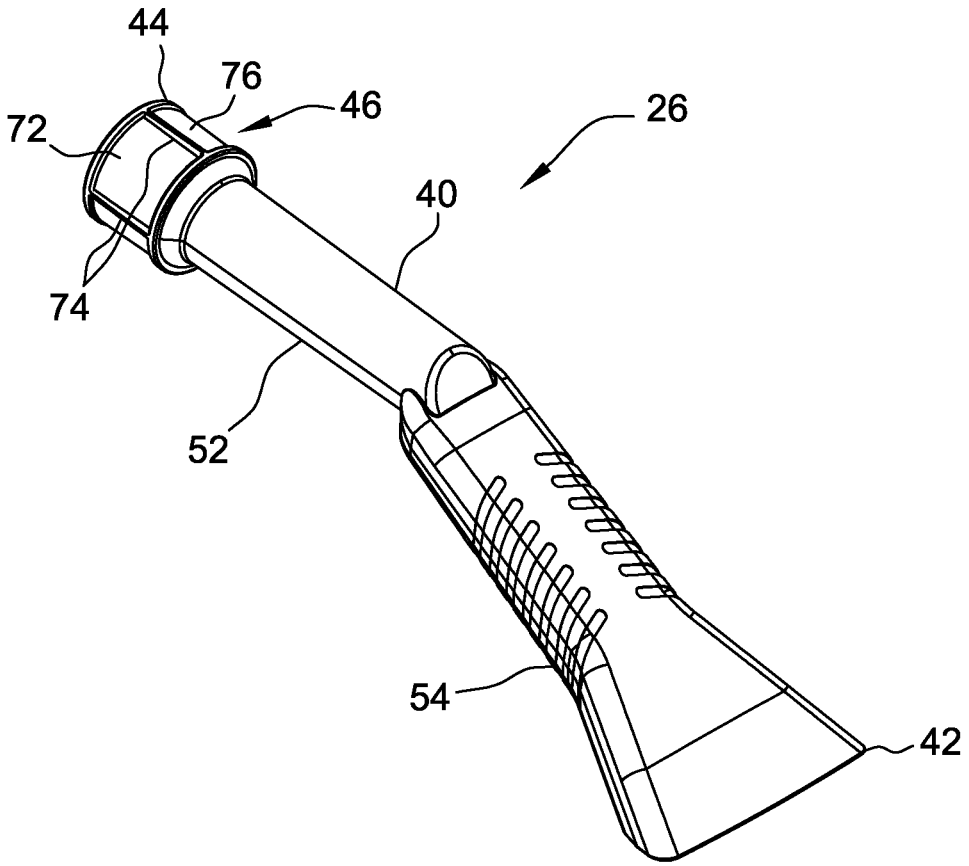
FIG. 2 is a perspective view of an example attachment tool of the vacuum cleaning system shown in FIG. 1.
Figure 3:
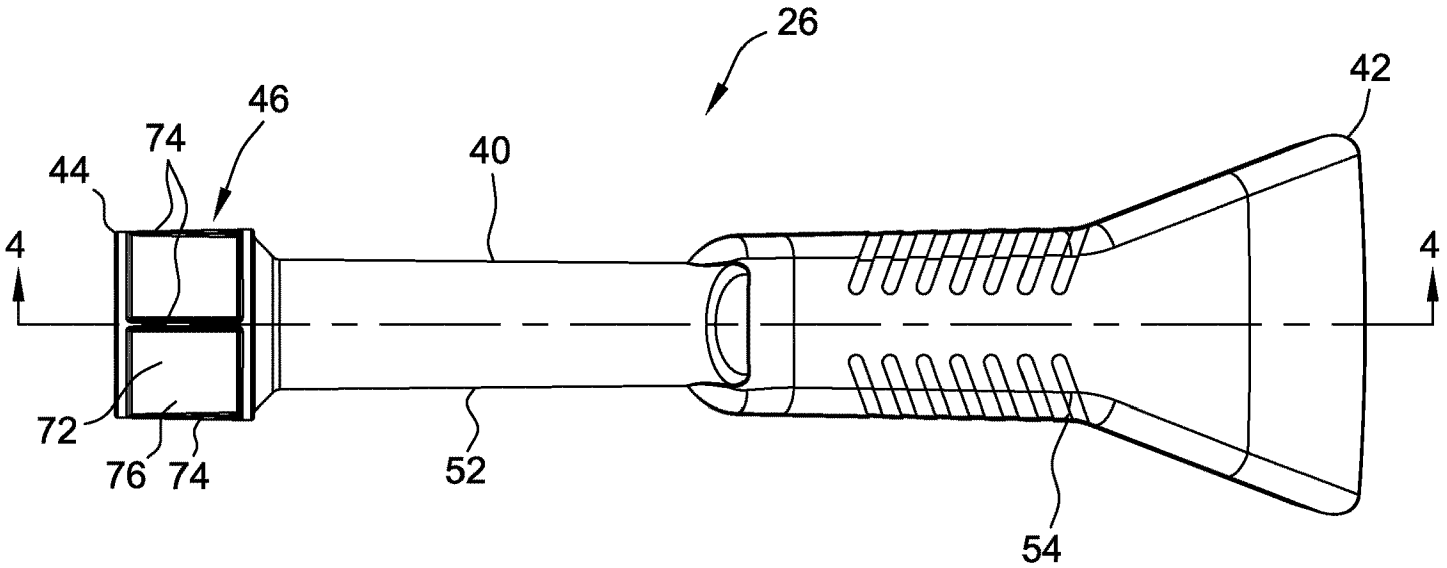
FIG. 3 is a top view of the attachment tool shown in FIG. 2.

FIG. 2 is a perspective view of the vacuum conduit attachment tool 26 shown in FIG. 1. FIG. 3 is a top view of the vacuum conduit attachment tool 26, and FIG. 4 is a sectional view of the vacuum conduit attachment tool 26 taken along line 4-4 shown in FIG. 3.

Figure 4:
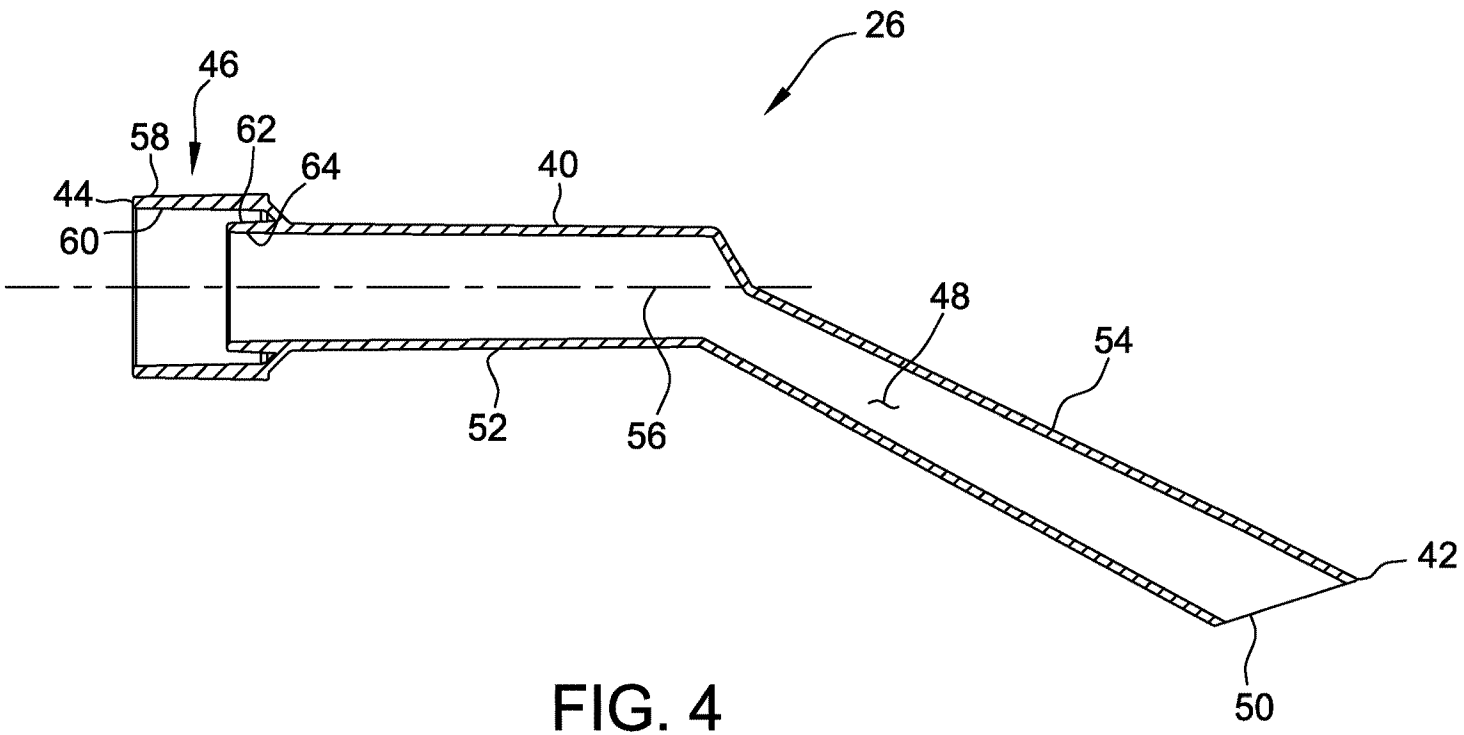
FIG. 4 is a sectional view of the attachment tool of FIG. 2 taken along line 4-4 shown in FIG. 3.

As shown in FIGS. 2-4, the vacuum conduit attachment tool 26 generally includes a hollow body 40 extending from a first end 42 to a second end 44, and a conduit connector 46 disposed at the second end 44 of the body 40 for connection to the second end 38 of the vacuum conduit 24. As shown in FIG. 4, the body 40 defines a suction flow path 48 (generally, a flow path) extending from the first end 42 to the second end 44, and defines a suction inlet 50 (generally, an inlet) for receiving debris therethrough. The conduit connector 46 is configured (sized, shaped and made of suitable material) for connection to the vacuum conduit 24 and, as described in more detail below, is designed for connection to various sizes (e.g., diameters) of vacuum conduits. When the attachment tool 26 is connected to the vacuum conduit 24 via the conduit connector 46, suction generated by the suction unit 22 is transferred to the attachment tool 26, generating airflow through the inlet 50 at the first end 42 of the body 40 towards the second end 44 of the body 40.

The attachment tool 26 may be constructed from a variety of suitable materials depending on the intended use or application of the attachment tool 26. In some embodiments, for example, the attachment tool 26 is constructed of a hard, rigid plastic including, for example and without limitation, polypropylene. In other embodiments, the attachment tool 26 may be constructed of any suitably rigid, semi-rigid, or flexible material that enables the attachment tool 26 to function as described herein including, for example and without limitation, PE, EVA, and rubber. In the illustrated embodiment, the attachment tool 26 has a unitary or monolithic construction. That is, the body 40 and the conduit connector 46 are formed as an integral, unitary piece. Suitable methods for forming the attachment tool 26 as a unitary or monolithic piece include, for example and without limitation, injection molding, precision machining, and casting.

In the illustrated embodiment, the body 40 of the attachment tool 26 includes a base portion 52 and a suction tip or nozzle 54. The base portion 52 has a generally cylindrical shape, and extends from the second end 44 of the body 40 to the suction nozzle 54 along a longitudinal axis 56 of the body 40. The suction nozzle 54 extends from the base portion 52 to the first end 42 of the body 40, and defines the inlet 50 at the first end 42 of the body 40. In the illustrated embodiment, the suction nozzle 54 is oriented at an oblique angle of about 30° relative to the longitudinal axis 56 of the body 40, and has square frusto-pyramidal shape that defines the inlet 50. In other embodiments, the suction nozzle 54 may extend at an oblique angle other than 30° relative to the longitudinal axis 56 of the body 40, such as between about 10° and about 80°, between about 10° and about 60°, between about 45° and about 90°, or between about 15° and about 45°. In yet other embodiments, the suction nozzle 54 may be oriented substantially parallel to the longitudinal axis 56 of the body 40. Further, in other embodiments, the end of the suction nozzle 54 may be shaped other than frusto-pyramidal, and will generally vary depending upon the intended use or application of the attachment tool.

Figure 5:
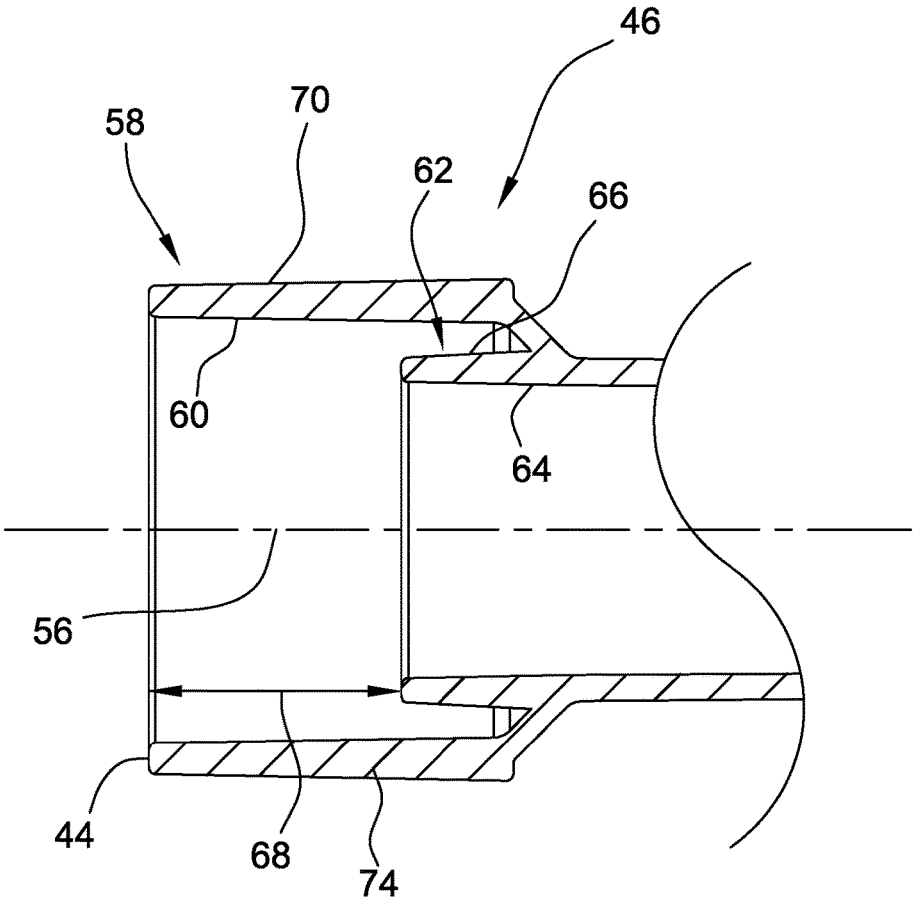
FIG. 5 is an enlarged sectional view of a conduit connector of the attachment tool shown in FIG. 4.

The conduit connector 46 is disposed at the second end 44 of the body 40 and, in the illustrated embodiment, is concentric with the cylindrical base portion 52. FIG. 5 is an enlarged sectional view of the conduit connector 46 shown in FIG. 4. As noted above, the conduit connector 46 of the present disclosure is configured for attachment to multiple sizes (e.g., diameters) of vacuum conduits. Consequently, vacuum conduit attachment tools that include the conduit connector 46, such as the attachment tool 26, can be used with vacuum conduits of different diameters. In particular, as shown in FIGS. 4 and 5, the conduit connector 46 includes an outer collar 58 defining a first inner engagement surface 60, and an inner collar 62 spaced radially inward from and concentric with the outer collar 58 and defining a second inner engagement surface 64. In the illustrated embodiment, the outer collar 58 and the inner collar 62 are circular in transverse cross-section, and define circular openings of different sizes for receiving different sized vacuum conduit ends (e.g., the second end 38 of the vacuum conduit 24) therein.

Figure 6:
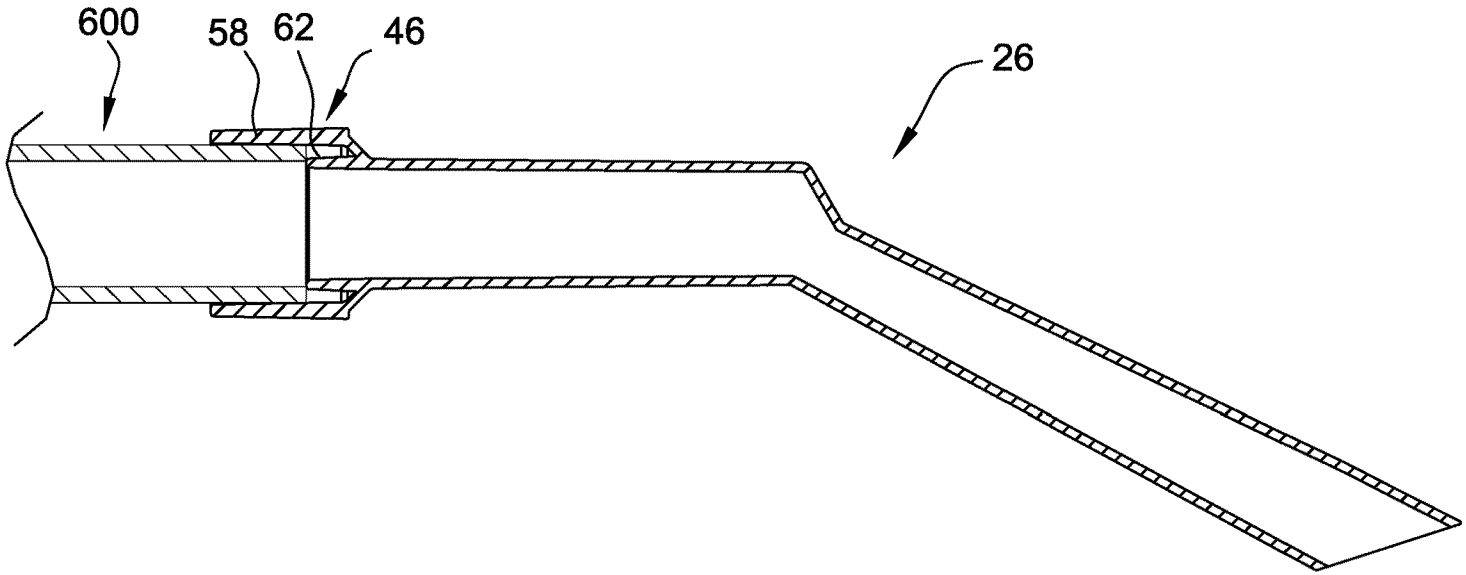
FIG. 6 is another sectional view of the attachment tool shown in FIG. 4, illustrating the attachment tool connected to a first vacuum conduit.
Figure 7:
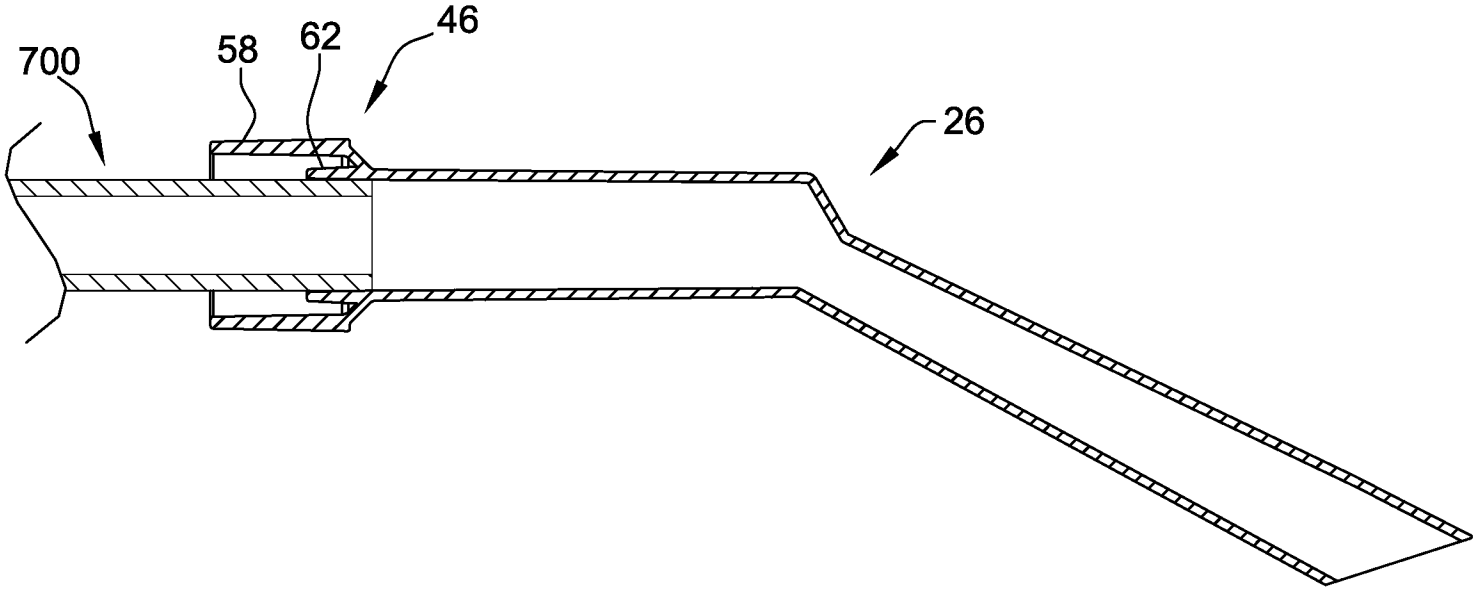
FIG. 7 is another sectional view of the attachment tool shown in FIG. 4, illustrating the attachment tool connected to a second vacuum conduit having a diameter smaller than the first vacuum conduit shown in FIG. 6.

The first and second inner engagement surfaces 60 and 64 are defined along respective radially inner surfaces of the outer and inner collars 58 and 62, and are circular in transverse cross-section in the illustrated embodiment. Moreover, the outer collar 58 has an inner diameter larger than an inner diameter of the inner collar 62. Thus, the first inner engagement surface 60 is sized for connection to an outer diameter of a first vacuum conduit 600 (shown in FIG. 6), and the second inner engagement surface 64 is sized for connection to an outer diameter of a second vacuum conduit 700 (shown in FIG. 7) smaller than the outer diameter of the first vacuum conduit. In other words, the attachment tool 26 is selectively attachable to vacuum conduits of different diameters along the first and second inner engagement surfaces 60 and 64.

The outer collar 58 and the inner collar 62 may have any suitable respective inner diameters that enable the attachment tool 26 to function as described herein. In some embodiments, the inner diameters of the outer and inner collars 58 and 62 are sized for connection to vacuum conduits having industry standard dimensions. In some embodiments, for example, the inner diameter of the outer collar 58 is sized to receive vacuum conduits having an outer diameter of about 1.875 inches, and the inner diameter of the inner collar 62 is sized to receive vacuum conduits having an outer diameter of about 1.25 inches. More specifically, to receive and form a friction fit connection with a vacuum conduit having an outer diameter of about 1.875 inches, the inner diameter of the outer collar 58 may be less than 1.875 inches, such as between about 1.7 inches and about 1.8 inches, or between about 1.72 inches and about 1.79 inches. To connect a vacuum conduit to the outer collar 58, the outer collar 58 may deflect radially outward and/or the end of the vacuum conduit may deflect radially inward to fit within the inner diameter of the outer collar 58. Additionally, the inner collar 62 may deflect radially inward, and/or the end of the vacuum conduit may deflect radially outward to fit around the outer diameter of the inner collar 62. To receive and form a friction fit connection with a vacuum conduit having an outer diameter of about 1.25 inches, the inner diameter of the inner collar 62 may be less than 1.25 inches, such as between about 1.20 inches and about 1.25 inches, between about 1.240 inches and about 1.250 inches, or about 1.245 inches. To connect a vacuum conduit to the inner collar 62, the inner collar 62 may deflect radially outward and/or the end of the vacuum conduit may deflect radially inward to fit within the inner diameter of the inner collar 62.

In the illustrated embodiment, the outer collar 58 and the inner collar 62 have non-uniform inner diameters. In particular, as shown in FIG. 5, each of the first and second inner engagement surfaces 60 and 64 tapers radially outward towards the second end 44 of the body 40. The outward taper of the first and second inner engagement surfaces 60 and 64 allows the outer and inner collars 58 and 62 to accommodate dimensional variations in vacuum conduits, and facilitates a tight friction fit with the outer diameter of a vacuum conduit. Additionally, in the illustrated embodiment, a radial outer surface 66 of the inner collar 62 tapers radially inward towards the second end 44 of the body 40. The radially inward taper of the radially outer surface 66 facilitates maintaining sufficient clearance between the inner collar 62 and the outer collar 58 to accommodate vacuum conduits of different thicknesses.

Referring still to FIG. 5, the inner collar 62 is axially offset from the outer collar 58 by a distance 68 towards the first end 42 of the body 40 (i.e., away from the second end 44 of the body 40). The axial offset between the inner collar 62 and the outer collar 58 facilitates maintaining a friction fit connection between the conduit connector 46 and a vacuum conduit, and also facilitates maintaining the structural integrity of the inner collar 62. For example, the axial offset distance 68 between the outer collar 58 and the inner collar 62 prevents the inner collar 62 from obstructing larger diameter vacuum conduits from being inserted into the conduit connector 46 a sufficient distance to engage a sufficiently large area of the first inner engagement surface 60 to maintain a sufficient friction fit connection between the attachment tool 26 and the vacuum conduit. Additionally, the axial offset between the inner collar 62 and the outer collar 58 avoids extending the tapered inner collar 62 beyond a length at which the taper of the inner collar 62 would cause the thickness of the inner collar 62 to be too small to maintain the structural integrity of the inner collar 62, thereby subjecting the inner collar 62 to possible permanent deformation and/or breaking during use.

The distance 68 by which the inner collar 62 is axially offset from the outer collar 58 may vary depending on the size of the outer and inner collars 58 and 62, and the size of the vacuum conduits for which the conduit connector 46 is configured for connection to. In some embodiments, the axial offset distance 68 is greater than the inner radius (i.e., one half of the inner diameter) of the outer collar 58. Further, in some embodiments, the axial offset distance 68 is less than the inner diameter of the outer collar 58. Moreover, in some embodiments, the axial offset distance 68 is between 0.5 and 1 times the inner diameter of the outer collar 58. In other embodiments, the axial offset distance 68 may be any suitable distance that enables the attachment tool 26 to function as described herein. In the illustrated embodiment, the axial offset distance 68 is about 1.06 inches.

Figure 8:
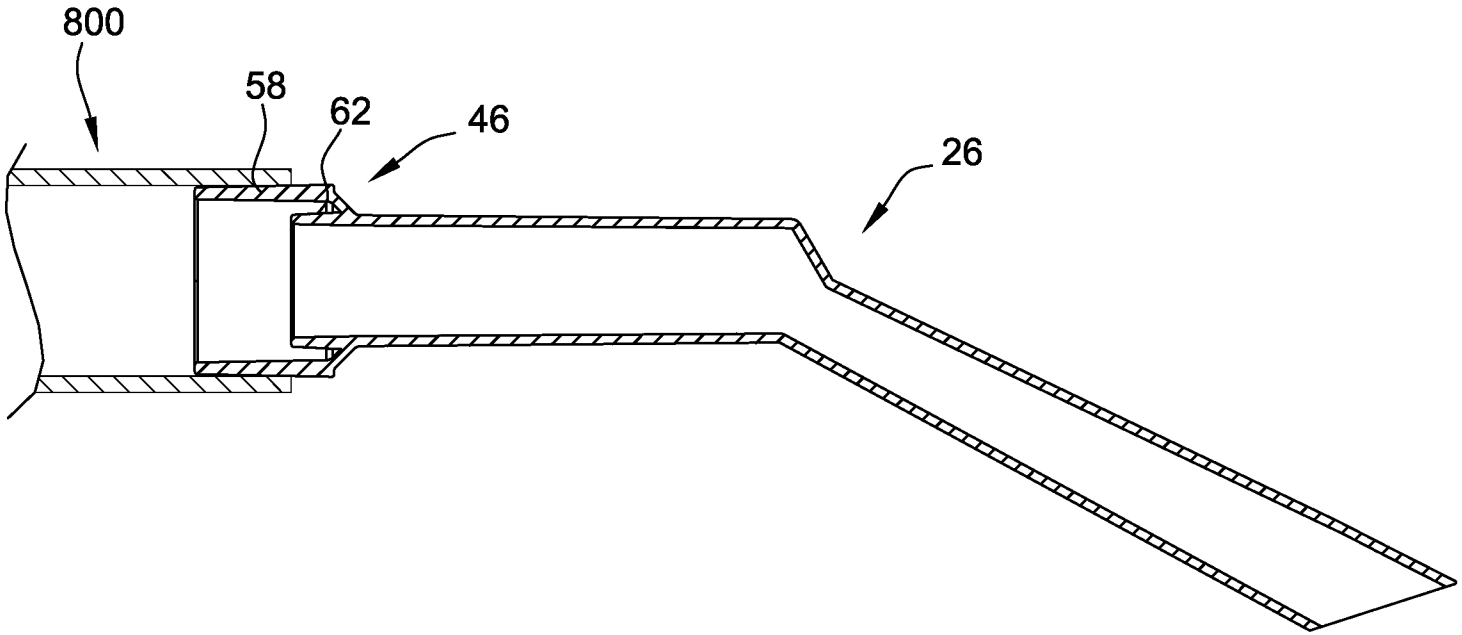
FIG. 8 is another sectional view of the attachment tool shown in FIG. 4, illustrating the attachment tool connected to a third vacuum conduit having a diameter larger than each of the first and second vacuum conduits shown in FIGS. 6 and 7.

In the illustrated embodiment, the outer collar 58 of the conduit connector 46 further includes an outer engagement surface 70 configured for a friction fit connection with an inner diameter of a vacuum conduit. The outer engagement surface 70 is defined along a radially outer surface of the outer collar 58. Further, the outer diameter of the outer collar 58 is greater than the inner diameters of the outer collar 58 and the inner collar 62. Thus, the outer engagement surface 70 is sized for connection to an inner diameter of a third vacuum conduit 800 (shown in FIG. 8) larger than each of the outer diameters of the first and second vacuum conduits 600 and 700.

The outer collar 58 may have any suitable outer diameter that enables the attachment tool 26 to function as described herein. In some embodiments, the outer diameter of the outer collar 58 is sized for connection to vacuum conduits having an industry standard inner diameter. In some embodiments, for example, the outer diameter of the outer collar 58 is sized for a friction fit connection with vacuum conduits having an inner diameter of between about 2.04 inches and about 2.09 inches, which are industry standard inner diameters for vacuum conduits having an outer diameter of 2.50 inches. More specifically, to receive and form a friction fit connection with a vacuum conduit having an outer diameter of about 2.5 inches, the outer diameter of the outer collar 58 may be less than about 2.50 inches, such as between about 2.0 inches and about 2.2 inches, between about 2.03 inches and about 2.09 inches, or between about 2.034 inches and about 2.092 inches.

With additional reference to FIGS. 2 and 3, in the illustrated embodiment, the outer collar 58 includes an annular sidewall 72 that defines the first inner engagement surface 60 (shown in FIG. 5), and a plurality of ribs 74 protruding radially outward from a radially outer surface 76 of the annular sidewall 72. The ribs 74 are spaced circumferentially about the longitudinal axis 56 of the body 40. Further, the plurality of ribs 74 defines the outer diameter of the outer collar 58, and at least partially defines the outer engagement surface 70 of the outer collar 58 in the illustrated embodiment. The plurality of ribs 74 defines a plurality of longitudinal engagement surfaces spaced circumferentially about the longitudinal axis 56 of the body 40 for engaging and forming a friction fit connection with the inner diameter of a vacuum conduit.

In some embodiments, the use of ribs 74 to define the outer engagement surface 70 of the outer collar 58, as opposed to a solid, continuous radial outer surface, facilitates manufacturing the attachment tool 26. For example, when the attachment tool 26 is formed by an injection molding process, forming the outer collar 58 as a solid collar with a continuous radial outer surface may result in processing defects, such as sink holes, during manufacturing of the attachment tool 26. The use of ribs 74 to define the outer engagement surface 70 facilitates avoiding such processing defects while providing an outer engagement surface with a suitable size and profile for connection to the inner diameter of a vacuum conduit. The illustrated embodiment includes 4 ribs spaced at equal circumferential distances about the longitudinal axis 56 of the body 40. In the example embodiment, the use of 4 ribs provides adequate sealing functionality along the outer engagement surface 70, while avoiding too much additional material mass in the outer collar 58 that might otherwise cause manufacturing or processing defects. Although the example embodiment includes 4 ribs, other embodiments may include more than or less than 4 ribs 74.

In the illustrated embodiment, the outer collar 58 has a non-uniform outer diameter. In particular, as shown in FIG. 5, each of the ribs 74 tapers radially inwards towards the second end 44 of the body 40. The inward taper of the ribs 74 allows the outer engagement surface 70 of the outer collar 58 to accommodate dimensional variations in vacuum conduits, and facilitates a tight friction fit with the inner diameter of a vacuum conduit.

In one embodiment, the conduit connector 46 is specifically configured for a friction fit connection to vacuum conduits constructed of rigid plastics, pliable plastics, nylons, rubbers, and metals that have an outer diameter of about 1.25 inches or about 1.875 inches, or in inner diameter of about 2.5 inches. More specifically, the conduit connector 46 is constructed of polypropylene, the first inner engagement surface 60 is configured for connection with vacuum conduits having an outer diameter of about 1.875 inches, the second inner engagement surface 64 is configured for connection with vacuum conduits having an outer diameter of about 1.25 inches, and the outer engagement surface 70 is configured for connection with vacuum conduits having an inner diameter of about 2.5 inches. In particular, the outer collar 58 has a circular cross-section, and the first inner engagement surface 60 tapers outward towards the second end 44 of the body 40 at a taper angle of about 2° from an inner diameter of about 1.74 inches to an inner diameter of about 1.79 inches; the inner collar 62 has a circular cross-section, and the second inner engagement surface 64 tapers outward towards the second end 44 of the body 40 at a taper angle of about 2° from an inner diameter of about 1.164 inches to an inner diameter of about 1.245 inches; and the ribs 74 partially defining the outer engagement surface 70 taper radially inward towards the second end 44 of the body 40 at a taper angle of about 2.17° from an outer diameter of about 2.108 inches to an outer diameter of about 2.050 inches.

Figure 9:
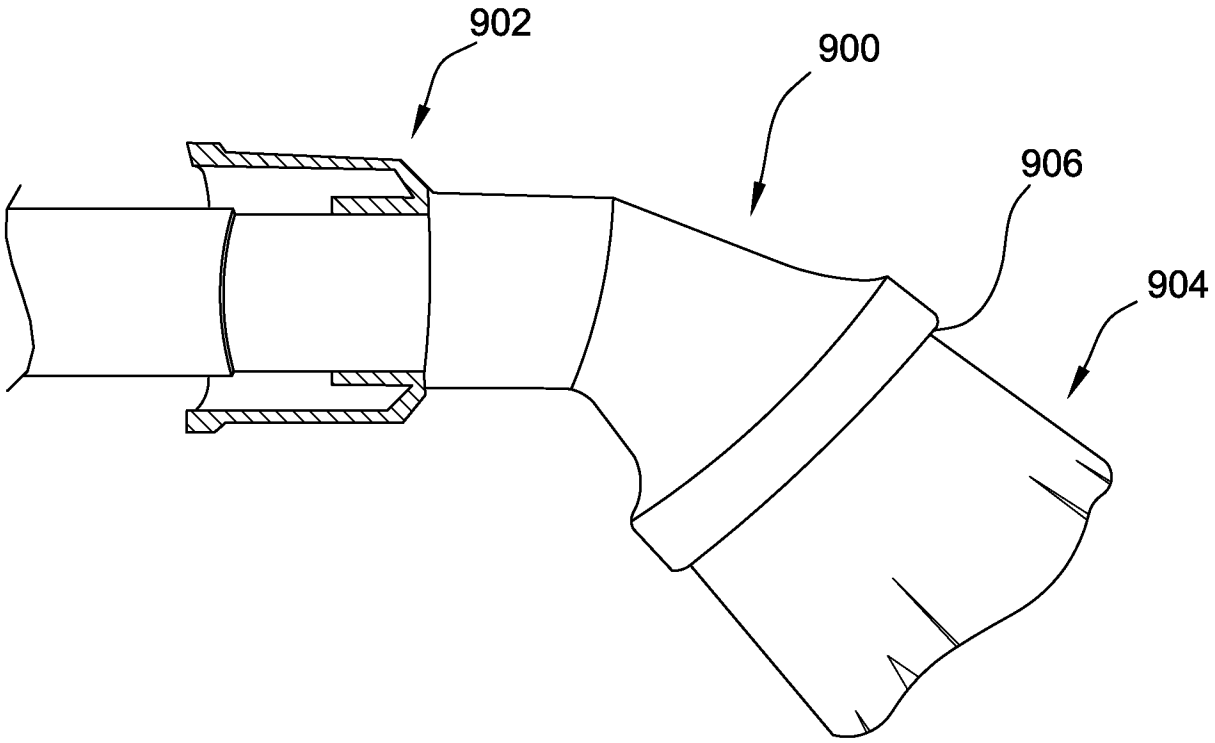
FIG. 9 is a side cutaway view of another embodiment of a vacuum conduit attachment tool including a conduit connector similar to the conduit connector shown in FIG. 5, the attachment tool shown connected to a vacuum conduit.

It should be understood that the conduit connector 46 and aspects thereof may be implemented in vacuum conduit attachment tools other than the vacuum conduit attachment tool 26 shown and described above with reference to FIGS. 1-8. FIG. 9, for example, is a side cutaway view of another embodiment of a vacuum conduit attachment tool 900 including a conduit connector 902 similar to the conduit connector 46. The vacuum conduit attachment tool 900 shown in FIG. 9 includes a brush 904 extending outward from a second or inlet end 906 of the attachment tool 900, and is colloquially referred to as a dusting brush or brush accessory.

Figure 10:
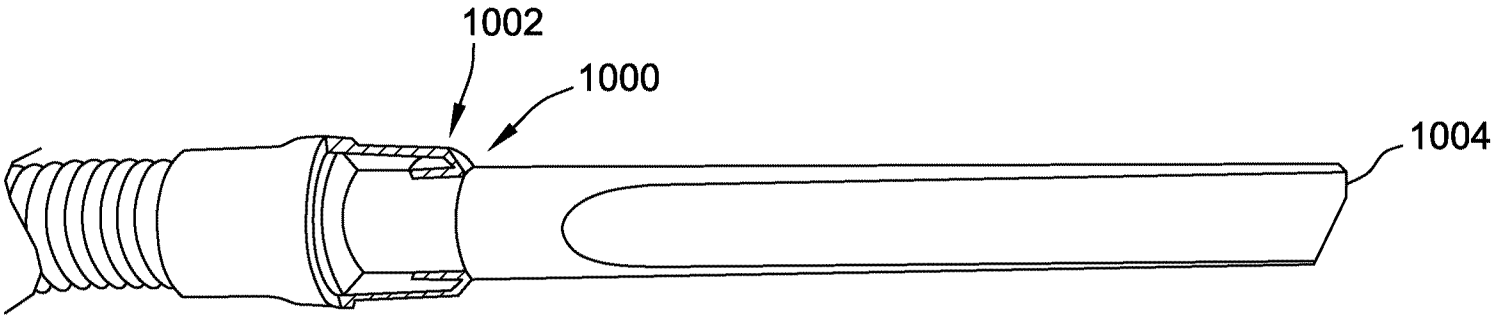
FIG. 10 is a side cutaway view of another embodiment of a vacuum conduit attachment tool including a conduit connector similar to the conduit connector shown in FIG. 5, the attachment tool shown connected to a vacuum conduit.

FIG. 10 is a side view of another embodiment of a vacuum conduit attachment tool 1000 including a conduit connector 1002 similar to the conduit connector 46. The vacuum conduit attachment tool 1000 shown in FIG. 10 has a relatively small, rectangular-shaped suction inlet 1004, and is colloquially referred to as a crevice tool. It should be understood that the conduit connector 46 and aspects thereof may be implemented in vacuum conduit attachment tools other than those described above, including, for example and without limitation, floor brushes, floor tools, utility nozzles, car nozzles, and triangular dusting brushes.

Embodiments of the vacuum conduit attachment tools described herein provide several advantages over prior art devices. For example, embodiments of the attachment tools described herein provide a single, unitary attachment tool that is connectable to multiple sizes of vacuum conduits without the need for separate vacuum accessories, such as adapters. The attachment tools of the present disclosure thereby reduce the total number of vacuum accessories needed for compatibility with different sizes of vacuum conduits. Embodiments of the attachment tools also provide benefits to manufacturers and distributors of vacuum cleaning systems and accessories by reducing SKU complexity for vacuum accessories, and by reducing the tooling requirements, such as the number of molds, needed to cover different connection combinations of different hose sizes and different attachment tools.

Additionally, embodiments of the vacuum conduit attachment tools facilitate maintaining a friction fit connection with vacuum conduits, and also facilitate maintaining the structural integrity of the attachment tool. In particular, embodiments of the vacuum conduit attachment tools include a conduit connector having a tapered inner collar that is axially offset from a tapered outer collar. The axial offset between the outer collar and the inner collar prevents the inner collar from obstructing larger diameter vacuum conduits from being inserted into the conduit connector a sufficient distance needed to maintain a sufficient friction fit connection between the attachment tool and the vacuum conduit. Additionally, the axial offset between the inner collar and the outer collar avoids extending the tapered inner collar beyond a length at which the taper of the inner collar would cause the thickness of the inner collar to be too small to maintain the structural integrity of the inner collar.

Further, embodiments of the attachment tools include an outer engagement surface configured for a friction fit connection with an inner diameter of a vacuum conduit to provide additional compatibility and versatility. In some embodiments, the outer engagement surface is at least partially defined by a plurality of radially-outward protruding ribs to facilitate manufacture of the attachment tool. In particular, the use of ribs to define the outer engagement surface facilitates avoiding processing defects that might otherwise result from forming the outer engagement surface from a solid, continuous surface.

Example embodiments of vacuum conduit attachment tools are described above in detail. The vacuum conduit attachment tools are not limited to the specific embodiments described herein, but rather, components of the vacuum conduit attachment tools may be used independently and separately from other components described herein. For example, the vacuum conduit attachment tools described herein may be used with vacuum cleaners other than wet/dry vacuum cleaners, including without limitation canister vacuum cleaners, upright vacuum cleaners, and backpack vacuum cleaners. As an additional example, the vacuum conduit attachment tools may be connected to the exhaust of a vacuum cleaner (via a suitable conduit, for example) or a blower and used to direct an outward airflow.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A vacuum cleaning system comprising:

a suction unit;

a vacuum conduit connected to the suction unit; and an attachment tool connected to an end of the vacuum conduit, the attachment tool including:

a hollow body extending from a first end to a second end and defining a flow path, the first end defining an inlet for receiving debris therethrough; and a conduit connector disposed at the second end of the body, the conduit connector including an outer collar defining a first inner engagement surface, and an inner collar concentric with the outer collar and defining a second inner engagement surface, each of the outer collar and the inner collar terminating at a respective free end, wherein the free end of the inner collar is axially offset from the free end of the outer collar towards the first end of the hollow body;

wherein the attachment tool is configured as one of a crevice tool, a dusting brush, a car nozzle, a floor brush, a floor tool, a utility nozzle, and a triangular dusting brush, and is connected to the vacuum conduit along one of the first inner engagement surface and the second inner engagement surface, and wherein the attachment tool is selectively attachable to vacuum conduits of different diameters along the first and second inner engagement surfaces.

2. The vacuum cleaning system of claim 1, wherein each of the inner engagement surfaces tapers radially outward towards the second end of the body to accommodate dimensional variations in vacuum conduits.

3. The vacuum cleaning system of claim 1, wherein the inner collar includes a radial outer surface that tapers radially inward towards the second end of the body.

4. The vacuum cleaning system of claim 1, wherein the outer collar further defines an outer engagement surface for connection to an inner diameter of a vacuum conduit.

5. The vacuum cleaning system of claim 4, wherein the outer collar includes a raised annular rim at the free end of the outer collar and a plurality of radially-outward protruding ribs extending axially from the raised annular rim and spaced circumferentially about a longitudinal axis of the body, wherein the plurality of ribs at least partially define the outer engagement surface.

6. The vacuum cleaning system of claim 5, wherein the outer engagement surface tapers radially inward towards the second end of the body to accommodate dimensional variations in vacuum conduits.

7. The vacuum cleaning system of claim 5, wherein the plurality of ribs define an outer diameter of the outer collar, wherein the outer diameter is in the range of 2.0 inches and 2.2 inches.

8. The vacuum cleaning system of claim 1, wherein the body and the connector have a unitary construction.

9. The vacuum cleaning system of claim 1, wherein the attachment tool is connected to the vacuum conduit by a friction fit.

10. The vacuum cleaning system of claim 1, wherein the inner collar is axially offset from the outer collar by a distance greater than one half of an inner diameter of the outer collar.

11. The vacuum cleaning system of claim 1, wherein the inner collar has an inner diameter in the range of 1.20 inches and 1.25 inches, and wherein the outer collar has an inner diameter in the range of 1.7 inches and 1.8 inches.

12. An attachment tool for a vacuum cleaning system, the attachment tool comprising:

a hollow body extending from a first end to a second end and defining a flow path, the first end defining an inlet for receiving debris therethrough; and a conduit connector disposed at the second end of the body, the connector including an outer collar defining a first inner engagement surface for connection to an outer diameter of a first vacuum conduit, and an inner collar concentric with the outer collar and defining a second inner engagement surface for connection to an outer diameter of a second vacuum conduit smaller than the outer diameter of the first vacuum conduit, each of the outer collar and the inner collar terminating at a respective free end, wherein the free end of the inner collar is axially offset from the free end of the outer collar towards the first end of the body, wherein the attachment tool is configured as one of a crevice tool, a dusting brush, a car nozzle, a floor brush, a floor tool, a utility nozzle, and a triangular dusting brush.

13. The attachment tool of claim 12, wherein each of the inner engagement surfaces tapers radially outward towards the second end of the body to accommodate dimensional variations in vacuum conduits.

14. The attachment tool of claim 12, wherein the first inner engagement surface is sized for connection to a vacuum conduit having an outer diameter of about 1.875 inches, and wherein the second inner engagement surface is sized for connection to a vacuum conduit having an outer diameter of about 1.25 inches.

15. The attachment tool of claim 12, wherein the outer collar further defines an outer engagement surface for connection to an inner diameter of a third vacuum conduit larger than each of the outer diameters of the first and second vacuum conduits.

16. The attachment tool of claim 15, wherein the outer collar includes a plurality of radially-outward protruding ribs spaced circumferentially about a longitudinal axis of the body, wherein the plurality of ribs at least partially defines the outer engagement surface.

17. The attachment tool of claim 15, wherein the outer engagement surface tapers radially inward towards the second end of the body to accommodate dimensional variations in vacuum conduits.

18. The attachment tool of claim 15, wherein the outer engagement surface is sized for connection to a vacuum conduit having an inner diameter of about 2.5 inches.

19. The attachment tool of claim 12, wherein the body and the connector have a unitary construction.

20. A method of assembling a vacuum cleaning system, the method comprising:

providing a suction unit, a vacuum conduit, and an attachment tool configured as one of a crevice tool, a dusting brush, a car nozzle, a floor brush, a floor tool, a utility nozzle, and a triangular dusting brush, the attachment tool including a hollow body extending from a first end to a second end and defining a flow path, and a conduit connector disposed at the second end of the body, the conduit connector including an outer collar defining a first inner engagement surface, and an inner collar concentric with the outer collar and defining a second inner engagement surface, each of the outer collar and the inner collar terminating at a respective free end, the free end of the inner collar axially offset from the free end of the outer collar towards the first end;

connecting a first end of the vacuum conduit to the suction unit;

determining a diameter of a second end of the vacuum conduit;

selecting, based on the diameter of the second end of the vacuum conduit, one of the engagement surfaces of the attachment tool for connection to the vacuum conduit; and connecting the vacuum conduit to the selected engagement surface.

* * * * *